US005814255A

United States Patent [19]

Weiser et al.

[11] Patent Number: 5,814,255

[45] Date of Patent: Sep. 29, 1998

[54] PROCESS AND DEVICE FOR THE CONTINUOUS PRODUCTION OF FIBER-REINFORCED MOLDED BODIES FROM HYDRAULICALLY SETTING MATERIALS

[75] Inventors: Wolfgang Weiser, Düsseldorf; Gerd Joy; Melanie Gerling-Joy, both of Wuppertal; Frank Cipriani, Düsseldorf, all of Germany

[73] Assignee: Durapact Gesellschaft für Glasfaserbetontechnologie mbH, Düsseldorf, Germany

[21] Appl. No.: 737,396

[22] PCT Filed: May 9, 1995

[86] PCT No.: PCT/EP95/01741

§ 371 Date: Nov. 8, 1996

§ 102(e) Date: Nov. 8, 1996

[87] PCT Pub. No.: WO95/30520

PCT Pub. Date: Nov. 16, 1995

[30] Foreign Application Priority Data

May 9, 1994 [DE] Germany ..... 44 16 160.3

[51] Int. Cl.[6] ..... B28B 11/00

[52] U.S. Cl. ..... 264/70; 264/165; 264/171.1; 264/172.19; 264/173.1; 264/173.11; 425/110; 425/115; 425/130

[58] Field of Search ..... 264/70, 165, 171.1, 264/172.19, 173.1, 173.11; 425/115, 130, 110

[56] References Cited

U.S. PATENT DOCUMENTS

| | | | |
|---|---|---|---|
| 2,405,528 | 6/1946 | Skolnik . | |
| 2,422,345 | 8/1947 | Easterberg et al. . | |
| 4,076,880 | 2/1978 | Geschwender | 428/116 |
| 4,242,407 | 12/1980 | Bijen | 428/247 |
| 4,344,804 | 8/1982 | Bijen et al. . | |
| 4,655,982 | 4/1987 | Meyer et al. | 425/115 |

FOREIGN PATENT DOCUMENTS

| | | |
|---|---|---|
| 900152 | 11/1984 | Belgium . |
| 0003245 | 8/1979 | European Pat. Off. . |
| 2442115 | 6/1980 | France . |
| 1159329 | 8/1966 | Germany . |
| 2434970 | 1/1975 | Germany . |
| 2640390 | 3/1977 | Germany . |
| 3331715 | 3/1985 | Germany . |
| 3315216 | 10/1993 | Germany . |
| 26355 | 5/1929 | Netherlands . |
| 1359128 | 12/1987 | U.S.S.R. . |
| 1428584 | 10/1988 | U.S.S.R. . |
| 2159066 | 11/1985 | United Kingdom . |

*Primary Examiner*—James Derrington
*Attorney, Agent, or Firm*—Friedrich Kueffner

[57] ABSTRACT

A process and a device for the continuous production of fiber-reinforced molded bodies from hydraulically setting materials, wherein the setting materials are applied in a given width from at least two dispensers with a defined thickness in at least two separate layers on conveyors moving in opposite directions. The conveyors are substrates whose color and external constitution corresponds to the outer surface of the molded body and on which the layers and surface structures of reinforcing fibers are applied. With the simultaneous injection of another material layer as an intermediate layers, the layers with the substrates are conveyed through the adjustable gap formed by a pair of cylinder rollers and the layers and substrates are united under predetermined pressure to form the molded body. Immediately after passing the gap, the molded body is deflected in a discharge direction using the cylinder rollers and is discharged with the adhering substrates.

18 Claims, 3 Drawing Sheets

PROCESS AND DEVICE FOR THE CONTINUOUS PRODUCTION OF FIBER-REINFORCED MOLDED BODIES FROM HYDRAULICALLY SETTING MATERIALS

BACKGROUND OF THE INVENTION

1. Field of the Invention

The invention is directed to a process and a device for the continuous production of fiber-reinforced molded bodies of hydraulically setting materials which are applied in at least one layer of predetermined width and thickness to a moving substrate from one or more dispensers and in which glass fibers serve as reinforcement.

2. Description to the Prior Art

DE 34 31 143 C2 describes a process for the production of molded bodies, e.g., slabs, of fiber-reinforced hydraulically setting materials in which the material is applied without fibers in a predetermined thickness to a substrate upon which fiber chips coming from a cutting mechanism are scattered in metered amounts on the surface of the material and are pressed into the material by a tool which acts along the entire working width, the material being compressed at the same time. A disadvantage consists in that there are only relatively small proportions of reinforcement material which, in addition, are in a statically unfavorable arrangement only in an external region of the slab.

Further, a process for the fabrication of molded bodies from fiber concrete in which fibers are sprayed, trickled or scattered on unset concrete and then rolled in or smoothed on is known from DE-AS 24 56 712. The fibers are continuously cut from a glass-fiber roving by a cutting mechanism. They can be applied in a plurality of layers, followed by a dusting of cement to absorb excess water. A concrete surface which is free of cracks and keeps out water better is supposed to be achieved by means of the fibers. The scattering and rolling in of the fibers is effected in a manual process with a cutting tool and a hand roller.

Apart from the unfavorable arrangement of the fiber layer, another disadvantage shared by the known process and devices consists in that they have only one "good side", namely the surface facing the shape-imparting substrates. In addition, the proportion of fibers in the concrete matrix is limited to approximately 5–6 percent by mass.

Further, processes are known in which hydraulically setting matrix material and separately conveyed glass fibers are sprayed on a substrate at the same time. In so doing, it is relatively difficult to adjust and maintain an exact mixture ratio of matrix to glass fibers. Further, a thickness sizing of the slabs produced in this way requires an additional process step with additional apparatus, and there is only one "good side".

Finally, it is known to apply to a substrate a uniformly thick layer of mixing material designated as "premix" which contains a homogeneous mixture of unset concrete and glass fibers. The working limits of "premix" are set by the proportion of glass fibers to be added because the workability of the mixture is impaired or destroyed with higher proportions and the reinforcement content for thin slabs is generally too small.

Slabs with different reinforcement are sometimes joined in their unset state after fabrication in order to obtain a slab of double thickness or to achieve two approximately good surfaces.

SUMMARY OF THE INVENTION

The slabs are then made into a "sandwich", requiring a delayed work step which substantially increases production costs.

The object of the present invention is to provide a process and a device for producing fiber-reinforced slabs of an exactly predetermined or small thickness, as appropriate, which slabs have two smooth or textured "good sides" if necessary and can be produced in high yields with controllable metering of proportions of reinforcement material, especially with higher reinforcement proportions and with exact positioning of the reinforcement in statically stressed zones of the slab layer. The slabs can be further processed into three-dimensional molded bodies immediately or subsequently while, however, in the unset state.

This object is met by the invention in a process of the type mentioned above in that a) a matrix material is applied in a defined thickness on substrates moving in opposite directions in at least two separate layers from at least two dispensers, b) surface structures of fibers are applied to the layers and/or the surface structures are placed on the substrates followed by the application of layers, c) the layers are moved together and are united under controlled pressure to form one product which is shaped on both outer surfaces, subjected to a thickness sizing, deflected in a discharge direction and discharged.

Compared to known processes, the present process offers the advantage that the work steps are automated in a continuous sequence so as to flow into one another and errors in accuracy such as those caused by the interaction of a plurality of interdependent work steps which are offset in time are avoided to a great extent. In the new process, fiber proportion in the reinforcement can, without exception, far exceed the quantity of roughly 5 percent by weight of the total matrix which was previously considered to be the maximum limit.

When using the alternative process in which the surface structures are placed on the substrates beforehand, the matrix material penetrates into or through the applied fiber mats. The first respective matrix layer is preferably applied on a permanently installed delivery table which is arranged upstream of the conveyer belt and provided with vibrators. This enables a more accurate thickness calibration than would be possible on the conveyor belt and ensures surface quality through the possibility of vibration from below.

The use of surface structures obviates a costly process for cutting fibers and enables a higher proportioning. Accordingly, a comparatively thin laminate of high strength can be produced. A high production speed with a correspondingly high yield can also be achieved owing to the use of surface structures. As a result of the exact positioning of the reinforcement surface structure in statically stressed zones, a maximum of strength is achieved by the effective use of the fiber reinforcement. Fiber dust and cement dust is extensively prevented by omitting the cutting and spraying process.

In one embodiment, a small proportion of glass fibers is admixed with the material during its preparation. Even with a fiber component of less than 1 percent by weight, for example, the concrete matrix which is prepared as a premix with the admixture of fibers benefits the material exiting from the dispensers as a first highly compacted layer with respect to its capacity to hold together and its plasticity, so that it acts as a dimensionally stable, nontearing film during its movement process. Further, this type of delivery prevents unwanted inclusion of air between the substrate and a first matrix layer. For example, the material can have an admixture of glass fibers amounting to 0.01 to 4 percent by weight, preferably between 1 and 1.5 percent by weight.

The material is applied in a continuous flow to the shape-imparting substrate and is extruded when appropriate. The dispensers are adjusted at a defined distance from the advancing substrates. In this way a given thickness of the first laminate layer is achieved and maintained with high accuracy.

The following can be used as fiber material: AR-glass fibers, E-glass fibers, C-glass fibers, or ECR-glass fibers, metal fibers (Fibraflex), microsteel fibers, plastic fibers, aramide fibers or carbon fibers. The surface structures can be continuous filament yarns, roving, bound glass-fiber mats, nonwoven or woven fabrics, scrim, interlaid scrim (also multiaxial), fiber-complex mats or combinations of these commercial forms.

In an embodiment which is substantial to the invention a material layer can be injected between the reinforced layers in the process of joining the latter. In this way or, e.g., by means of styroprene blocks or other organic or mineral material in the form of plates or blocks, an inseparable bond of the layers to be joined is achieved, their setting process is benefited and, in the case of a subsequent shaping, the plasticity of the slab is improved so that the as yet unset slab-shaped product can easily be subjected to a shaping process, e.g., to form three-dimensional structures. Such shaping can be used, for instance, to produce corrugated slabs, gutters, pipes and the like products.

When glass fibers are used as reinforcement in the concrete material, alkalinization-inhibiting components, preferably pozzolans, fly ash, reactive silicon dioxide or other additions having the same effect are advantageously admixed in quantities equivalent to the alkaline reaction. This ensures long-term stability of the glass fibers without corrosion.

Profiled substrates can be used to achieve a surface profile on one or two sides of the product and/or profiled cylinder rollers can be used for deflection when the two layers are joined. The individual matrix layers are sized by adjustment of a distance between the outlet opening of the dispenser or hopper and the substrate. The final product is exactly presized and then resized by means of precision-sizing rollers by measuring the gap between the deflecting roll cylinders.

Another step substantial to the invention consists in that the materials are degassed and/or compressed in the dispensers by vibrating. Further, the matrix layers can also be vibrated during or after their application on the substrates and are further compressed in this way. At the same time, the applied surface structures are intimately combined with the matrix layer receiving them as a result of the vibrating movements.

The layers are deflected in the course of being joined with the use of cylinder rollers and are shaped at both outer surfaces between the substrates with predetermined application of pressure and connected with one another at the same time. In this way, the surfaces of the product are kept exactly parallel and a predetermined slab thickness is automatically achieved with great accuracy without additional work steps. Further, the newly joined layers can be supported and resized in the deflection region in the discharge direction using at least one support roller. The presizing in the defined gap between the deflecting cylinder rollers and the resizing are facilitated in that netting, mats, fiber-complex mats, (uniaxial/multiaxial) scrim, woven and nonwoven fabrics or cut portions thereof are used as fiber surface structures which, owing to their cohesiveness, impart a considerably greater strength in comparison to cut fibers which are embedded, sprinkled on or sprayed on. Finally, after the product has been produced, the substrates can be detached preferably from both sides of the finished body in a last work step.

Another great advantage of the process consists in that it proceeds "cleanly", extensively without emission of fiber dust or cement dust, produces little or no waste and accordingly satisfies sanitary workplace requirements.

A device for the continuous fabrication of fiber-reinforced molded bodies of hydraulically setting materials for carrying out the process according to the invention, comprising at least one movable substrate and, above the latter, delivery hoppers for delivering a material layer onto the substrate and fiber discharging and metering devices and means for introducing fibers into the material layer is characterized in that it has two substrates which are movable in opposite directions and are guided such that they can be deflected around a pair of drivable cylinder rollers and at least one delivery hopper associated with every substrate, as well as a metering device for glass-fiber surface structures and means for integrating the latter in the material which is applied in layers, and in that an adjustable gap is formed between the cylinder rollers. In an embodiment substantial to the invention a delivery hopper is arranged above the gap of the cylinder rollers. Further advantageous constructions of the devices are provided in the subclaims.

In a highly advantageous manner, the device is uncomplicated and compact in comparison with the multiple-layer product which can be produced, and enables a high yield with extreme accuracy of the layer sequence in the final product at relatively high manufacturing speeds.

Preferred embodiment forms of the invention are shown in schematic drawings which indicate further advantageous particulars of the invention.

DESCRIPTION OF THE PREFERRED EMBODIMENTS

Figure 1:
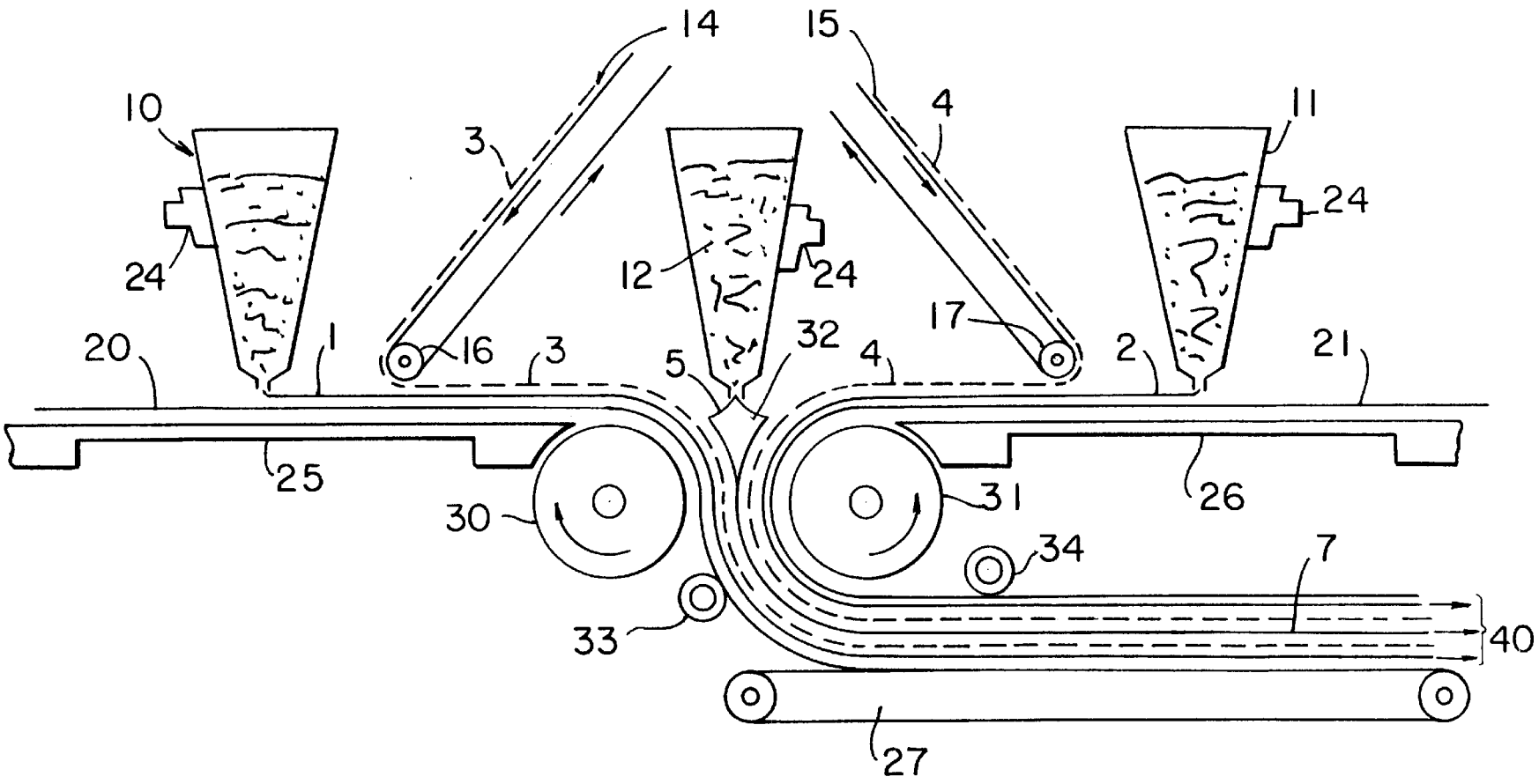
FIG. 1 shows a side view of the device in the manner of a flow sheet.

FIG. 1 shows a device for the continuous production of fiber-reinforced molded bodies from hydraulically setting materials. This device has two substrates (20, 21) which are movable in opposite directions and guided such that they can be deflected around a pair of drivable cylinder rollers (30, 31), and at least one delivery hopper (10, 11) associated with every substrate (20, 21), in addition to metering devices (14, 15) for glass-fiber surface structures (3, 4). The delivery hoppers (10, 11) are arranged vertically and have below them in each instance a gap opening which is designed at an adjustable distance from the substrates (20, 21) in width and in gap distance. The substrates (20, 21) can be sheets of material of an optional kind. They can be outfitted at the surface with a coating to prevent the adherence of the concrete material to be applied, e.g., silicone, and are textured where appropriate in order to shape the outer surfaces of the product (7) to be formed. However, the substrates (20, 21) can also be drainage mats (e.g., ZemDrain) which can be used for dewatering the matrix layer (1 or 2) located thereon by means of vacuum, whereas other substrates (20, 21) only determine the desired visual properties of the layers (1, 2) and enable them to be joined. An individual thickness adjustment of the matrix layers (1 and 2) is provided using an adjustable distance between the gap opening of the hoppers (10, 11) and the substrates (20, 21) in cooperation with the amount of matrix delivered from the hoppers (10 and 11) per time unit in proportion to the transporting speed of the substrates (20, 21). The fiber metering devices (14, 15) for the fiber surface structures (3, 4) can be continuous belts which are guided around the deflecting rolls (16, 17).

An additional delivery hopper (12) is advisably arranged above the gap (32) formed between the cylinder rollers (30, 31). This delivery hopper (12) introduces an intermediate layer (5) between the layers (1, 2) which have already been produced, including the fiber layers (3, 4), and produces the composite action of the layers (1, 2); (3, 4) for the sandwich structure of the final product (7).

Supports (25, 26) are arranged below the substrates (20, 21) in the region of the delivery hoppers (10, 11) arranged above the latter and the metering devices (14, 15). These supports (25, 26) serve as gliding supports for the substrates (20, 21) which are guided above them, but are also advantageously outfitted with vibrators which cause intensive vibrating movements in the applied layers (1, 2) and the reinforcement layers (3, 4) at the same time and accordingly compact and degas the matrix layers (1, 2) and, by means of vibrations, bring about an intimate connection between a matrix layer (1, 2) and the associated layer (3, 4) of fiber surface structures to form a homogeneous composite action.

The substrates (20, 21) and/or the cylinder rollers (30, 31) can have a smooth or textured surface. Accordingly, concurrently with the continuous fabrication of the slab-shaped product (7), both surfaces of the latter are provided with a determined constitution or quality—either completely smooth or with a textured pattern. This surface quality can be selected freely on both surfaces or can be provided on only one surface or can be effected differently on both surfaces.

A final product (7) which is free from cavities and has a dense or tight quality is achieved in that the supports (25, 26), delivery hoppers (10–12) and/or cylinder rollers (30, 31) are constructed with vibrators (24).

Figure 2:
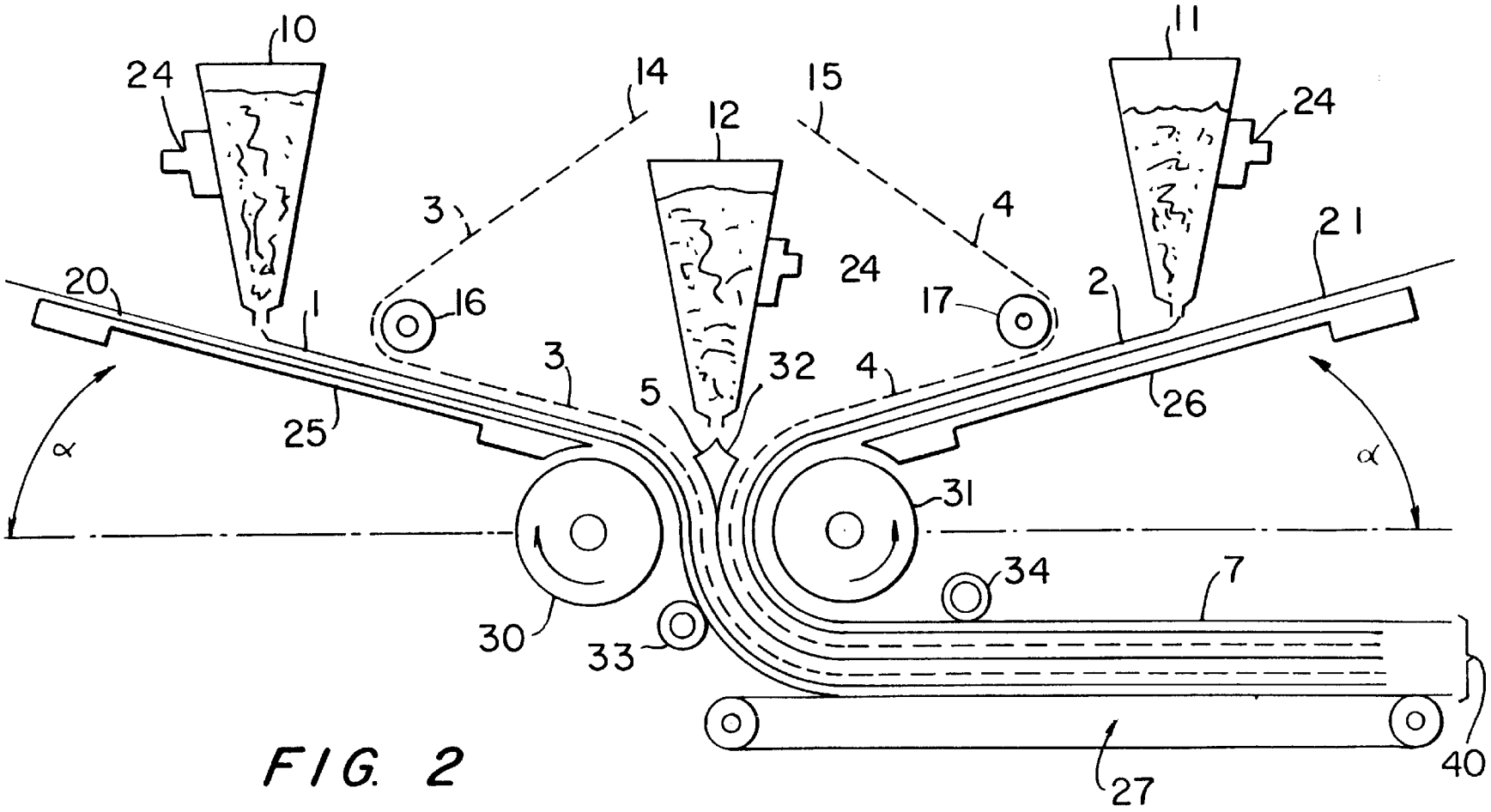
FIG. 2 shows another construction of the installation according to FIG. 1.

FIG. 2 shows a slightly modified construction of the device. In this construction, the supports (25, 26) with the substrates (20, 21) located thereon and the hoppers (10, 11) are raised on one side and inclined diagonally downward relative to one another. Supports (25, 26) and substrates (20, 21) in this construction have means (not shown) for adjusting the inclination at an optionally adjustable angle alpha and for raising the hoppers (10, 11). By inclining the aforementioned installation parts, wherein the fiber metering devices (14 and 15) with the deflecting rolls (16 and 17) also follow the adjustment at angle alpha, the matrix layers (1, 2) formed on the substrates (20, 21), along with the glass-fiber reinforcements (3, 4) and the middle layer (5), are united in a frictional and positive engagement with the assistance of the force of gravity in the gap (32) to form an intimate composite. For the rest, the device shown in FIG. 2 presents a construction which is basically identical to the device shown in FIG. 1, wherein identical elements are designated by identical reference numbers.

Figure 3:
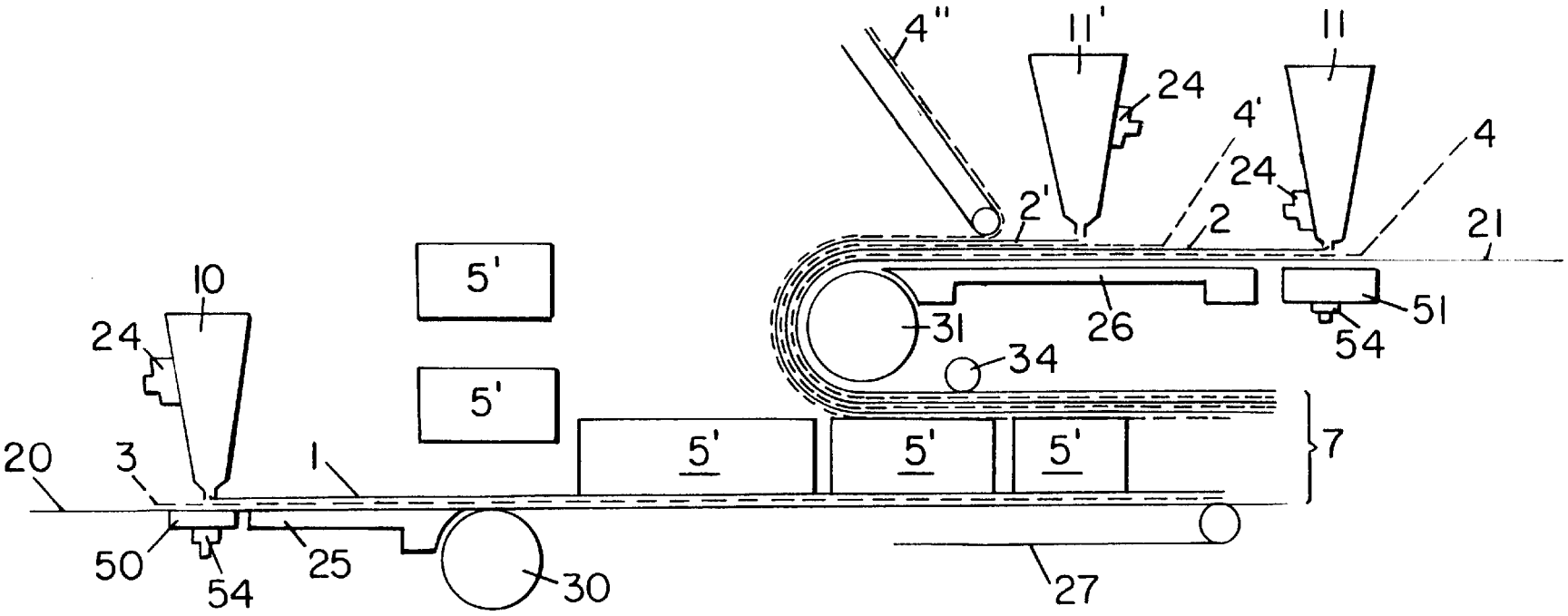
FIG. 3 shows another schematic view of the installation according to the invention.

FIG. 3 shows another construction of the device. In this construction, delivery tables (50, 51) are arranged in front of the supports (25, 26) in each instance and are each outfitted with vibrators (54). Vibrators (54) may be provided at optional locations, preferably at the delivery point. The hoppers (10, 11) are arranged above the delivery tables (50, 51) and the substrates (20, 21) are conveyed between them, the surface structures (3, 4) being applied to the latter diagonally from above. The layers (1, 2) are then applied on the surface structures (3, 4) from the matrix dispensers (10, 11). One or more surface structures (4') can be applied in turn to layer (2) and, for example, also to layer (1)—not shown—and another matrix layer (2') can be dispensed from the delivery hopper (11') onto this surface structure (4') in the construction shown here, this surface structure (4') being covered by another surface structure (4"). The sandwich construction is deflected over the cylinder roller and placed on the styroprene blocks (5') set up in the region of the cylinder roller (30). The finished product (7) is discharged from the device by the conveyor belt (27) after undergoing a final precision sizing by means of the resizing rollers (34).

The process according to the invention is carried out without the known spraying technique and without sprinkling on or pressing in fibers.

The slabs which can be produced by means of the invention have very advantageous characteristics. When constructed singly, they can be extremely thin but very stable at the same time. Further, they can be constructed with a filling, especially when using a lightweight concrete, so as to be light and thick, with a smooth or textured surface on one or two sides, and may be suitable for further shaping. If required, the process enables a very high proportioning of fiber by means of inserting fiber surface structures and positioning them exactly. For the further processing of unset fiber-reinforced laminates, these laminates can assume a great many shapes by means of winding, pressing, placing on or folding. It has proven particularly advantageous to define the slab thickness with absolute exactness by means of compressing and squeezing between the cylinder rollers (30, 31) and the precision-sizing rollers (33, 34). In a premix matrix which can contain fiber contents between 0.01 percent by weight and 4 percent by weight, surface structures in an amount up to 20 percent by weight may be inserted between the matrix layers (1 and 2). The matrix can be formed predominantly of cement, normal cement or special cement with added gypsum and, when appropriate, with lightweight aggregates such as pumice or expanding clay, foamed glass, additives, water, polymers and anti-aging agents. The invention opens up a wide range of economical applications and new products for the slabs produced in this way. To this extent, the stated object is met in optimum fashion by the invention.

The steps according to the invention are not limited to the embodiment examples shown in the drawings. Possible modifications of the process and device according to the invention can consist in optional layers and/or surface structures in optional quantities upstream or downstream of the first or additional hoppers. Different arrangements of the cylinder rollers are also conceivable, e.g., one above the other, with or without relative displacement with reference to the vertical. The respective construction design is left up to the person skilled in the art for adapting to particular uses of the device.

We claim:

1. A process for the continuous production of fiber-reinforced molded bodies from hydraulically setting materials, the process comprising applying setting materials in a given width from at least two dispensers with a defined thickness in at least two separate layers on conveying means moving in opposite directions, wherein fibers serve as reinforcement, the process further comprising:

(a) applying the layers of setting materials and surface structures of reinforcing fibers on the conveying means comprising substrates whose color and external constitution corresponds to an outer surface of the fiber-reinforced molded body;

(b) moving the layers with the substrates together and conveying the layers with the substrates with the use of cylinder rollers and simultaneous injection of another material layer as an intermediate layer through an adjustable gap formed by the cylinder rollers, and uniting and connecting the layers and the substrates on the predetermined controlled pressure to form the fiber-reinforced molded body which is shaped on both outer surfaces, and subjecting the fiber-reinforced molded body to a thickness sizing; and (c) immediately after passing the roller gap, deflecting the fiber-reinforced molded body in a discharge direction with the use of the cylinder rollers and discharging the body with the adhering substrates.

2. The process according to claim 1, comprising supporting and resizing with the use of precision-sizing rollers the fiber-reinforced molded body which has been sized by the cylinder rollers.

3. The process according to claim 1, comprising preparing the material by admixing thereto a quantity of glass fibers of between 0.01% by weight and a maximum of 4% by weight, and applying the material in a continuous flow to the substrate, and adjusting the dispensers at a defined distance from the substrate.

4. The process according to claim 3, wherein the quantity of glass fibers is between 0.1 and 1.0% by weight.

5. The process according to claim 1, wherein the fiber-reinforced molded body is slab-shaped, further comprising subjecting the molded body to a shaping process before the material has set.

6. The process according to claim 1, wherein the material is reinforced by glass fibers, further comprising admixing to the material alkalinization-inhibiting components in quantities equivalent to the alkaline reaction.

7. The process according to claim 6, wherein the alkalinization-inhibiting components are pozzolans, fly ash, or reactive silicone dioxide.

8. The process according to claim 1, wherein the substrates are profiled for achieving a surface profile on one or both sides of the molded body.

9. The process according to claim 1, wherein the cylinder rollers are profiled for achieving a surface profile on one or both sides of the molded body.

10. The process according to claim 1, comprising vibrating the material of the layers after being applied to the substrates for degassing and compressing the material.

11. The process according to claim 1, comprising using as fiber surface structures netting, mats, fiber-complex mats, woven and non-woven fabrics or cut portions thereof.

12. The process according to claim 1, comprising detaching the substrates from the molded body.

13. A device for the continuous production of fiber-reinforced molded bodies from hydraulically setting materials, the device comprising conveying means moving in opposite directions, delivery hoppers above the conveying means for delivering at least one material layer on each of the moveable conveying means, and fiber discharging and fiber metering devices and means for applying fiber surface structures to the material layer, further comprising:

(a) a pair of driveable cylinder rollers with smooth and/or profiled surfaces mounted so as to form an adjustable gap, supports arranged in the region of the delivery hoppers and the metering devices, substrates configured to be moveable in opposite directions with the layers located thereon and guided by the supports through the gap from top to bottom and deflected by the cylinder rolls;

(b) a receiving hopper arranged directly above the gap for injection an intermediate layer material; wherein (c) the supports with the substrates located thereon can be inclined diagonally downwardly relative to one another at an optionally adjustable angle and have means for adjusting the inclination and for raising the delivery hoppers.

14. The device according to claim 13, further comprising precision sizing rollers arranged downstream of the cylinder rollers.

15. The device according to claim 13, wherein at least one of the supports, the delivery hoppers and the cylinder rollers include vibrators.

16. A device for the continuous production of fiber-reinforced molded bodies from hydraulically setting materials, the device comprising conveying means moving in opposite directions, delivery hoppers above the conveying means for delivering at least one material layer on each of the moveable conveying means, and fiber discharging and fiber metering devices and means for applying fiber surface structures to the material layer, further comprising driveable cylinder rollers with smooth and/or profile surfaces for guiding substrates with the layers located thereon, wherein one substrate is guided around one of the cylinder rollers and another of the substrates is guided by another of the cylinder rollers without being deflected, the cylinder rollers being arranged at a vertical distance from each other, such that a distance between the substrates and fiber surface structures located thereon is such that an intermediate space remains between the material layers, further comprising means for placing material blocks in the intermediate space.

17. The device according to claim 16, comprising delivery tables arranged in front of the supports, wherein the delivery tables include vibrators.

18. A process for the continuous production of fiber-reinforced molded bodies from hydraulically setting materials, the process comprising applying setting materials in a given width from at least two dispensers with a defined thickness in at least two separate layers on conveying means moving in opposite directions, wherein fibers serve as reinforcement, the process further comprising:

(a) applying the layers of setting materials and surface structures of reinforcing fibers on the conveying means comprising substrates whose color and external constitution corresponds to an outer surface of the fiber-reinforced molded body;

(b) moving a first of the layers with the substrate around a first cylinder roller and then in a conveying direction and moving a second of the layers with the substrate so as to be guided by a second cylinder roller without being deflected, the cylindrical rollers being arranged at a vertical distance such that a distance between the substrates with the layers located thereon is such that an intermediate space remains between the layers; and (c) inserting material blocks into the intermediate space between the layers for connecting the layers.

* * * * *